United States Patent [19]

Fichtner

[11] 4,246,673

[45] Jan. 27, 1981

[54] BAND FOR OPERATING ON SHOES

[75] Inventor: Rudi Fichtner, Rosbach, Fed. Rep. of Germany

[73] Assignee: USM Corporation, Farmington, Conn.

[21] Appl. No.: 25,538

[22] Filed: Mar. 30, 1979

[30] Foreign Application Priority Data

Apr. 4, 1978 [DE] Fed. Rep. of Germany ..... 2814509

[51] Int. Cl.[2] ..... A43D 21/12

[52] U.S. Cl. ..... 12/14.4; 12/1 R

[58] Field of Search ..... 12/14.4, 10.1, 10.5, 12/8.1, 8.2, 12.4, 12.5

[56] References Cited

U.S. PATENT DOCUMENTS

| | | | |
|---|---|---|---|
| 2,986,753 | 6/1961 | Gilbride | 12/8.2 |
| 3,255,475 | 6/1966 | Ralphs | 12/14.4 |
| 3,689,952 | 9/1972 | Dawson et al. | 12/14.4 |
| 3,818,526 | 6/1974 | Garner et al. | 12/10.1 |

*Primary Examiner*—Patrick D. Lawson

*Attorney, Agent, or Firm*—Donald N. Halgren; Vincent A. White

[57] ABSTRACT

A flexible band for wrapping about a shoe contour. The band comprises an inner and an outer steel band with a resilient insert arranged therebetween. The inner and outer bands each comprise a toe portion and two side portions. The portions of the inner band overlap, and the portions of the outer band do not overlap. The flexible band also includes an innermost shoe-engaging member attached to the steel bands. The shoe-engaging member has a low friction portion at its toe section and a high friction portion on each side. The present construction permits a longer utility to the band while providing improved flexibility therewith.

10 Claims, 3 Drawing Figures

BAND FOR OPERATING ON SHOES

BACKGROUND OF THE INVENTION (1) Field of the Invention

This invention relates to shoe machines, and more particularly to toe bands utilized in shoe pulling and lasting machines.

(2) Prior Art

There is disclosed in U.S. Pat. Nos. 2,986,753 and 3,818,526, granted in the names of A. J. Gilbride and D. H. Garner et al, respectively, pulling and lasting machines utilizing flexible toe bands which are conformable to the toe end of a shoe. Relative heightwise movement between the band and the shoe acts to secure the shoe upper heightwise to conform it closely to a shoe last shape. The shoe upper is thereafter wiped inwardly over and secured to the shoe bottom by separate wipers. The toe band shown in the first above-cited patent comprises a band of synthetic material which is riveted securely to a supporting metal strip having tabs which, through an arrangement of arms connected thereto, apply a wrapping force to the band.

A further U.S. Pat. No. 3,606,625 granted to C. Ioannilli, and assigned to USM Corporation,, as are the others, describes a flexible toe band wherein the supporting metal strip is mounted by a T-slot so as to permit slight movement between the toe band and its supporting metal strip.

These toe bands can withstand the mechanical loading of the wrapping force and subsequent tension forces for only a relatively short period of time. The plastic bands of the prior art are reinforced with steel bands to increase the life of the band and to make their applied pressure more uniform. These steel supporting bands may break prematurely, and require replacement even when used with bands made from strong, long lasting material such as polytetrafluroethylene (PTFE). This material is sufficiently hard and elastic to transmit the required forces generated in the toe band. However, PTFE has a smooth surface which is not desirable in the rear region of a toe band, that is, the distal portions of the arms thereof. This condition permits the leather of the upper, especially in the side region of the toe band, to slip out of the toe band before the upper can be lasted.

It is an object of the present invention to provide a toe band which has an increased life span and which prevents the slipping of the leather in the side region of the upper during the wiping operation.

BRIEF SUMMARY OF THE INVENTION

The present invention comprises a toe band that has an elastic insert between an inner and an outer steel band. The elastic insert may be made from a plastic or rubber material which has several interwoven textile layers running generally longitudinally therethrough. The steel bands are not unitary, but are each made up of a forepart portion for the toe portion of the upper being lasted, and two side portions. The individual component parts of the outer steel band do not overlap. The individual contiguous parts of the radially inner band do overlap, and are curved so as to eliminate the possibility of damage to the adjacent elastic insert to which the bands are riveted. An innermost shoe engaging band, attached to the inner steel band is made from several materials. The forepart region thereof, which may be heavily stressed in the toe cap region, is constructed from a flexible yet firm material such as polytetrafluoroethylene because of its mechanical properties. In the side regions of the toe band, the innermost shoe-engaging band is made from a material with a high coefficient of friction in relation to leather to prevent slippage therebetween. This material is preferably a rubber type substance. The side portions of the high friction material need not extend all the way forward as the side portions of the inner steel band. Additionally, the outer radius of the plastic material of the shoe engaging band is greater than the inner radius of the outer reinforcement, (the steel bands and insert). This permits a free space between the plastic material shoe-engaging band and the outer reinforcement, in the toe region, during a relaxed condition of the toe band, preventing unnecessary stresses in the respective portions thereof due to changes in curvature therebetween.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENT

Figure 1:
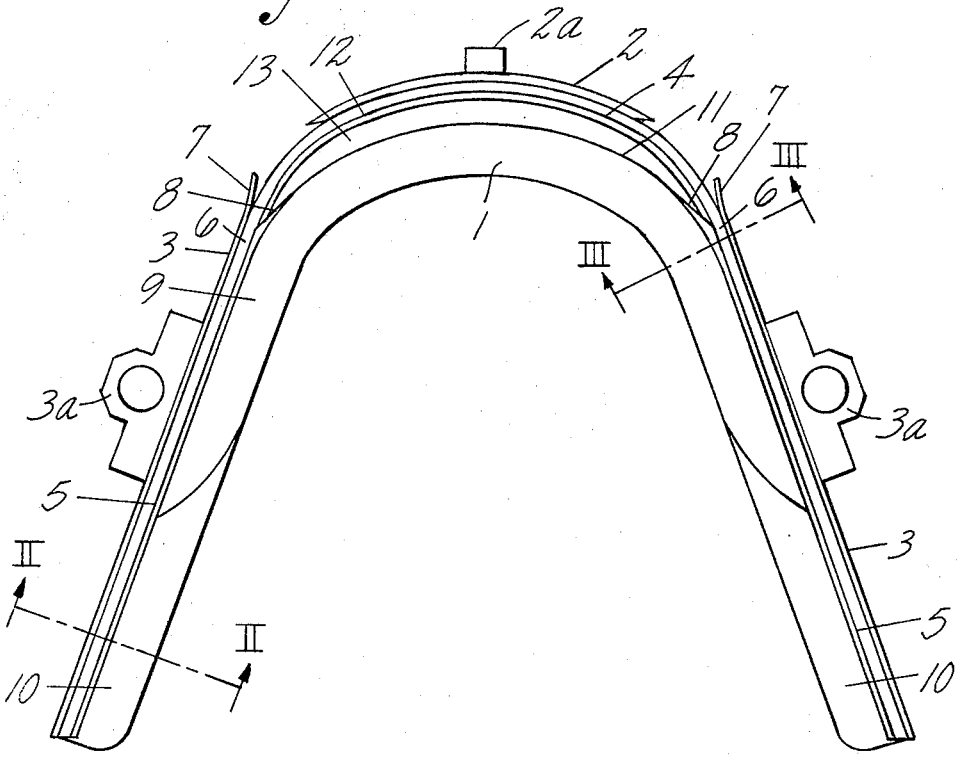
FIG. 1 shows a plan view of one embodiment of the toe band.

Referring now to the drawings in detail, and particularly to FIG. 1, there is shown a toe band comprising a shoe-engaging inner band 1 and an arrangement of bands comprising an outer reinforcement. The outer reinforcement comprises an outer steel band which is subdivided into a forepart portion 2 and a pair of side portions 3. An arrangement of tabs or link elements, 2*a* and 3*a* are connected to the forepart portion 2 and the side portions 3, respectively to permit interconnection with forward or side pressure devices as described in the aforementioned patents. The outer reinforcement includes a radially inner steel band which also is comprised of a forepart portion 4, and a pair of side portions 5.

An elastic insert 6 made from a textile reinforced elastomeric material, such as the type used for drive belts, is securely arranged between the radially inner and radially outer steel bands, by a plurality of rivets or the like. As shown in FIG. 1, each side portion 3 of the radially outer steel band has and end 7, which faces towards the toe region of the toe band, and which curves outwardly from the elastic insert 6. Each side portion 5 of the inner steel band has a corresponding end 8 at its toeward portion which curves inwardly and away from the elastic insert 6 thereadjacent. In further regard to the radially inner steel band, the end portion 8 of the side portion 5 serves to provide an overlap between the forepart portion 4 and the side portions 5 thereof, in both the relaxed and the compressed condition. At the same time, the forepart portion 4 of the inner steel band overlaps the side portions 3 of the outer steel band. On the other hand, the forepart portion 2 of the outer steel band does not extend back to the side portions 3 of the outer steel band, leaving a gap therebetween. The forces arising in this region of this gap are absorbed on the one side by the elastic insert 6, and on the other side by the forepart portion 4 or the side portions 5 of the inner steel band.

Figure 2:
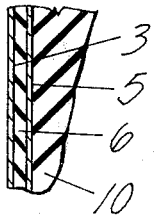
FIG. 2 shows a cross-sectional view taken along the lines II—II of FIG. 1.
Figure 3:
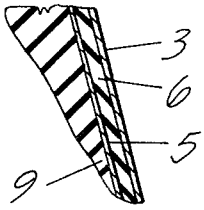
FIG. 3 shows a cross-sectional view taken along the lines III—III of FIG. 1.

The shoe-engaging innermost band 1 is also subdivided into a forepart portion 9 and a pair of side portions 10 as indicated in FIGS. 2 and 3. The forepart portion 9 of the shoe-engaging innermost band 1 may extend substantially further down the sides of the toe band than the forepart portion 4 of the inner steel band. The forepart portion 9 of the innermost band 1 may extend practically into the side lasting region of the toe band. The forepart region 9 is preferably made of a tough flexible material such as polytetrafluoroethylene, and which run into the side portions 10 which are made from a material having a higher coefficient of friction, such as rubber or rubber-like material. The forepart portion 9 and the side portions 10 may be durably secured together by means such as inter-engaging pegs or the like, not shown.

The outer reinforcement and the shoe-engaging innermost band 1 may be interconnected by a plurality of rivets or the like, not shown, which also secure the side portions 3 of the outer steel band to the innermost shoe-engaging band.

The shoe-engaging innermost band 1 has an outer radius of curvature 11, and the outer reinforcement has an inner radius of curvature 12, as shown in FIG. 1. The outer radius of curvature 11 on the shoe-engaging band is greater than the inner radius of curvature 12 on the outer reinforcement, providing a free space 13 therebetween during a relaxed condition of the toe band. The free space 13 is arranged so that when the toe band is pressed by an associated shoe machine, the outer reinforcement even in the toe region thereof abuts against the shoe-engaging innermost band fully and uniformly. In this way, unnecessary excessive stress in the shoe-engaging innermost band is avoided.

I claim:

1. A toe band for utilization in a shoe lasting machine, said toe band comprising:

a radially innermost shoe-engaging band;

an outer reinforcement member comprising an arrangement of two steel bands with an elastic insert extending therebetween.

2. A toe band as recited in claim 1, wherein said elastic insert comprises a flexible material reinforced by at least one fabric layer therewithin.

3. A toe band as recited in claim 1 wherein said steel bands comprise an inner band and an outer band, each of said steel bands having a forepart portion and a pair of side portions.

4. A toe band as recited in claim 3, wherein a gap is arranged between adjacent portions of said outer steel band.

5. A toe band as recited in claim 3, wherein adjacent portions of said inner steel band overlap one another.

6. A toe band as recited in claim 3, wherein said forepart portion of the inner steel band overlaps said side portions of said outer steel band.

7. A toe band as recited in claim 3, wherein the ends of said side portions towards the toe region of the outer steel band curve outwardly, and the ends of said side portions towards the toe region of the inner steel band curve inwardly.

8. A toe band as recited in claim 1, wherein said shoe-engaging band is comprised of a forepart portion for the toe portion and a pair of side portions thereattached.

9. A toe band as recited in claim 8, wherein said forepart region of said shoe-engaging band has a lower coefficient of friction with regard to a leather shoe to be secured thereby than said side portions, which have a higher coefficient of friction with respect to the leather shoe.

10. A toe band as recited according to one of claims 1 to 9, wherein said shoe-engaging band has an outer radius of curvature, and said outer reinforcement member has an inner radius of curvature both at the forepart region, said outer radius of curvature being greater than said inner radius of curvature, to provide a free space therebetween when said toe band is in a relaxed condition.

* * * * *